US007383842B1

(12) United States Patent
Sabol et al.

(10) Patent No.: US 7,383,842 B1
(45) **Date of Patent: *Jun. 10, 2008**

(54) SCREENINGS WASHER APPARATUS

(75) Inventors: Rob T. Sabol, Aliso Viejo, CA (US); John W. Schatzlein, Garden Grove, CA (US)

(73) Assignee: JWC Environmental, Santa Ana, CA (US)

( * ) Notice: Subject to any disclaimer, the term of this patent is extended or adjusted under 35 U.S.C. 154(b) by 27 days.

This patent is subject to a terminal disclaimer.

(21) Appl. No.: 11/498,260

(22) Filed: Aug. 3, 2006

(51) Int. Cl.
*B08B 3/02* (2006.01)

(52) U.S. Cl. ..... 134/65; 134/132

(58) Field of Classification Search ..... 134/132, 134/135, 65

See application file for complete search history.

(56) References Cited

U.S. PATENT DOCUMENTS

| | | | | |
|---|---|---|---|---|
| 1,459,713 | A | | 6/1923 | Beggs |
| 1,915,799 | A | | 6/1933 | Preston |
| 1,930,709 | A | | 10/1933 | De Lore |
| 2,098,026 | A | | 11/1937 | Booge et al. |
| 2,136,280 | A | | 11/1938 | Dickinson |
| 2,198,785 | A | | 4/1940 | Mohr et al. |
| 2,355,777 | A | | 8/1944 | Benson |
| 2,425,117 | A | | 8/1947 | Newsom |
| 2,548,895 | A | | 4/1951 | Graham et al. |
| 2,910,398 | A | | 10/1959 | Durant et al. |
| 3,078,169 | A | | 2/1963 | McCadam |
| 3,681,851 | A | | 8/1972 | Fleming |
| 3,703,970 | A | | 11/1972 | Benson |
| 3,715,977 | A | * | 2/1973 | Mackenzie ..... 100/117 |
| 3,804,670 | A | | 4/1974 | Farmer |
| 3,910,775 | A | | 10/1975 | Jackman |
| 4,046,324 | A | | 9/1977 | Chambers |
| 4,256,035 | A | | 3/1981 | Neufeldt |
| 4,411,797 | A | | 10/1983 | Sander et al. |
| 4,702,422 | A | | 10/1987 | Chambers, Sr. et al. |
| 5,061,380 | A | | 10/1991 | Stevenson |
| 5,122,263 | A | | 6/1992 | Huber |

(Continued)

FOREIGN PATENT DOCUMENTS

| | | |
|---|---|---|
| DE | 34 40 754 | 5/1986 |

(Continued)

OTHER PUBLICATIONS

Parkson Corporation, BioGuard Influent Cleaning System brochure (exact date unknown).

(Continued)

*Primary Examiner*—Frankie L Stinson
(74) *Attorney, Agent, or Firm*—Sughure Mion, PLLC

(57) ABSTRACT

A screenings washer having a hopper, a grinder downstream of the hopper, and a washer downstream of the grinder. The washer includes an auger rotor that receives the screenings ground by the grinder, a spray wash system that sprays a wash fluid directly onto a portion of said auger rotor and the ground screenings, a perforated trough, and tubular casing directly coupled to the discharge end of said auger rotor and having a severe bend proximate to the discharge end of said auger rotor. The severe bend partially obstructing transportation of the ground screenings transported by said auger rotor so as form a compaction zone that compacts and de-waters the ground screenings.

21 Claims, 12 Drawing Sheets

U.S. PATENT DOCUMENTS

| | | | | |
|---|---|---|---|---|
| 5,270,000 | A | 12/1993 | Goldner et al. | |
| 5,341,826 | A | 8/1994 | Huber et al. | |
| 5,377,921 | A | 1/1995 | Wirth | |
| 5,378,375 | A | 1/1995 | Bache | |
| 5,390,592 | A * | 2/1995 | Schnell et al. | 100/127 |
| 5,426,866 | A | 6/1995 | Rumocki | |
| 5,460,195 | A | 10/1995 | Celi | |
| 5,516,049 | A | 5/1996 | Zoncada | |
| 5,556,237 | A | 9/1996 | Rexius | |
| 5,566,890 | A | 10/1996 | Ricciardelli | |
| 5,570,845 | A | 11/1996 | Lewis et al. | |
| 5,580,521 | A | 12/1996 | Gagne | |
| 5,595,349 | A | 1/1997 | Bergstrom et al. | |
| 5,611,268 | A | 3/1997 | Hamilton | |
| 5,641,360 | A | 6/1997 | Bischof | |
| 5,979,804 | A | 11/1999 | Abrams et al. | |
| 6,156,128 | A | 12/2000 | Zierler | |
| 6,294,085 | B1 | 9/2001 | Bache | |
| 6,357,682 | B1 * | 3/2002 | Hext | 241/161 |
| 6,505,550 | B2 * | 1/2003 | Hamilton | 100/148 |
| 6,733,663 | B1 * | 5/2004 | Simon et al. | 210/104 |
| 7,080,650 | B1 | 7/2006 | Sabol et al. | |
| 7,081,171 | B1 | 7/2006 | Sabol et al. | |
| 7,086,405 | B1 | 8/2006 | Sabol et al. | |

FOREIGN PATENT DOCUMENTS

| | | | |
|---|---|---|---|
| DE | 91 09 180 | U | 10/1991 |
| DE | 44 12 689 | A | 10/1995 |
| DE | 299 18 072 | | 2/2000 |
| EP | 0198461 | A | 10/1986 |
| FR | 597779 | A1 | 5/1994 |
| JP | 05-38597 | A | 2/1993 |
| JP | 60-285452 | | 10/1994 |
| JP | 2001-314825 | A | 11/2001 |
| WO | WO 93/02800 | A | 2/1993 |
| WO | WO 97/26019 | A | 7/1997 |
| WO | WO 98/34731 | A | 8/1998 |

OTHER PUBLICATIONS

JWC Environmental, Screenings Washer Monster brochure (Oct. 2000).
JWC Environmental, "Monster Matters" newsletter (Jul. 2000).
JWC Environmental, Screenings Washer Monster advertisement (Jul. 2000).
JWC Environmental, Screenings Washer Monster news release (Jul. 2000).
JWC Environmental, Screenings Washer System brochure (Jan. 2000).
JWC Environmental, Screenings Washer Monster advertisement (Jan. 2000).
JWC Environmental, Screenings Washer Monster presentation (Jun. 2000).
JWC Environmental, Muffin Monster advertisement (Jan. 2000).
JWC Environmental, Septage Receiving System brochure (Mar. 2000).
JWC Environmental, Septage Receiving System news release (Jul. 2000).
Waterlink Separations, Inc., Hycor Products brochure (exact date unknown).
Huber Technology, Inc., Screenings Wash Press brochure (exact date unknown).
*The Lakeside Times*, Septage Receiving Program article (exact date unknown).
Hycor Corporation, Heliclean brochure (exact date unknown).
Hycor Coroporation, advertisement (exact date unknown).
Hycor Corporationm Helisieve brochure (exact date unknown).
JWC Environmental, Screenings Washer Monster specification (Jan. 2000).
JWC Environmental, Septage Receiving System specification (Jan. 2000).
JWC Environmental Screenings Washer Brochure (Jun. 15, 2000).

* cited by examiner

SCREENINGS WASHER APPARATUS

CONTINUATION INFORMATION

This application claims the benefit of U.S. provisional application Ser. No. 60/286,356 filed on Apr. 26, 2001, and U.S. non-provisional application Ser. No. 10/131,040 filed Apr. 25, 2002. The contents of both of these applications are hereby incorporated by reference in their entirety.

TECHNICAL FIELD

This invention relates to a screenings washer for processing screenings and, more particularly, to a screenings washer for grinding, washing, compacting and de-watering screenings containing soluble and non-soluble matter.

BACKGROUND

The demand for improved screenings treatment systems to process screenings from waste water continues to increase, with the demand being greatest for screenings treatment systems that are compact, that have low installation and maintenance costs, and that process screenings to produce a clean, odorless discharge with a significantly reduced volume for lower transport and landfill costs.

One such screenings treatment system developed by JWC ENVIRONMENTAL is the SCREENINGS WASHER SYSTEM. This system includes a hopper, a grinder disposed beneath the hopper, and an inclined wash system beginning below the grinder and extending upwards beyond the hopper. The wash system includes an inclined auger rotor, a spray wash system, and an inclined screen that are housed in a straight discharge tubular structure. In operation, the hopper receives screenings captured by a bar screen and gravity feeds the screenings to the grinder for solids reduction. The ground screenings are then gravity fed to the wash system. Softer organics (such as fecal material) and wash fluid from the spray wash system pass through openings in the inclined screen. The unwanted solids are captured and transported upwards by the auger to the discharge end of the tubular structure for disposal. The soft organics and the wash fluid are returned to the plant's waste stream.

Since the SCREENINGS WASHER SYSTEM is a "pull" type system that uses an inclined auger to wash and transport the screenings, the discharged screenings are fragmented, and, therefore, take up considerable space compared to compacted screenings that are formed into plugs. Furthermore, the inclined washer results in a system that requires a relatively large space.

WO 93/02800 discloses a screenings treatment system that includes a hopper, a coarse material separator disposed in the hopper, a mechanical reduction unit disposed below the hopper, a mixing trough with a horizontal mixer and a wash fluid sprayer disposed below the mechanical reduction unit, a de-watering and compaction unit adjacent the mixing trough, and a discharge pipe coupled to a discharge end of the de-watering and compaction unit.

In operation, the hopper receives screenings onto the coarse material separator, which removes coarse material. The remaining screenings are fed into the mechanical reduction unit, which shears the screenings. The sheared screenings are received by the mixing trough overflowing with water sprayed from wash fluid sprayer. The horizontal mixer swirls the water and the screenings to wash the screenings and dissolve the soluble matter contained therein. The dissolved soluble matter and screenings near the top of the mixing trough are carried by the overflowing water over an overflow edge of the mixing trough and into the de-watering and compaction unit. The de-watering and compaction unit includes a conveyor and de-watering screw arranged inside a screen housing that discharges liquid into a drain. The conveyor and de-watering screw transports the washed screenings that remain in the screen housing to an axial end of the screen housing. There, the end of the conveyor and the de-watering screw projects into the discharge pipe. The discharge pipe is curved upwards and rises up to an elbow whose discharge end is located above a container for final disposal. The screenings transported into the discharge pipe form a friction plug in the pipe. This causes the screenings to be compacted and simultaneously de-watered.

One disadvantage with the screenings washer system disclosed in WO 93/02800 is the provision of the mixing trough with its own horizontal mixer and wash fluid sprayer and the separate de-watering and compaction unit adjacent the mixing trough. This complicates the system significantly, requiring an additional motor to operate the horizontal mixer. In addition, the mixing trough operates on the principle that the screenings will overflow from the top edge of the trough. However, in reality, screenings may collect at the bottom of the mixing trough. Furthermore, since the fluid sprayer sprays into the mixing trough and not onto the screw and screen housing, the screw and screen housing are not continuously washed with clean water, thereby adding to the maintenance costs.

This invention is directed to an improved screenings washer that overcomes one or more of the problems set forth above.

SUMMARY OF THE INVENTION

It is, therefore, desirable to provide a screenings washer that is self-contained, compact, mechanically simple, and efficient.

In one aspect of the invention, a screenings washer is provided having a hopper that collects screenings; a grinder coupled to the hopper downstream of the hopper, wherein the grinder grinds the screenings collected by the hopper; and a washer coupled to the grinder downstream of the grinder.

The washer includes an auger rotor that rotates about an auger rotor axis and that receives the screenings ground by the grinder and transports the ground screenings to a discharge end of the auger rotor. The washer also includes a spray wash system that sprays a wash fluid directly onto a portion of the auger rotor and the ground screenings in contact with the auger rotor while the auger rotor conveys the ground screenings along the rotor axis to the discharge end of the auger rotor. The washer further includes a perforated trough disposed at a bottom of the auger rotor to drain the wash fluid sprayed directly onto the auger rotor.

A tubular casing is directly coupled to the discharge end of the auger rotor and has a severe bend proximate to the discharge end of the auger rotor, the severe bend provides resistance to (i.e., partially obstructs) transportation of the ground screenings transported by the auger rotor so as to form a compaction zone that compacts and dewaters the ground screenings from a substantial portion of the wash fluid remaining in the ground screening after passing the discharge end of the auger rotor.

According to another aspect of the invention, a screenings washer is provided having a tubular casing that is directly coupled to the discharge end of the auger rotor, and wherein the tubular casing includes a discharge segment having a tapered cross-section expanding in a direction of discharge of the ground screenings.

According to still another aspect of the invention, a screenings washer is provided having an auger rotor that includes a first spiral substantially extending an entire length of the auger rotor, and a second spiral formed at the discharge end of the auger rotor and extending a short distance in an upstream direction of the auger rotor, thereby forming a double spiral near the discharge end of the auger rotor.

According to yet another aspect of the invention, a screenings washer is provided having a control unit configured to control an operation of the screenings washer in a normal mode operation so that, when the control unit senses a signal indicating screenings are being fed to the screenings washer, the control unit cause the auger rotor to:

(1) first, operate in a first forward sequence, in which the auger rotor rotates in a direction that transports the ground screenings towards the discharge end, for a first predetermined amount of time;

(2) next, operated in a reverse sequence, in which the auger rotor rotates in a direction opposite to that of the forward sequence, for a second predetermined amount of time; and (3) next, operate in a second forward sequence, in which the auger rotor rotates in the direction that transports the ground screenings towards the discharge end, for a third predetermined amount of time.

According to still another aspect of the invention, a screenings washer is provided having a control unit configured to monitor at least one of a current and a voltage corresponding to a power consumption of the screenings washer; and wherein, when the power consumption exceeds a maximum allowable threshold value, the control unit changes a run sequence of the auger rotor to a forward only sequence, in which the auger rotor only rotates in a direction that transports the ground screenings towards the discharge end.

In accordance with yet another aspect of the invention, a method of processing screenings is provided using a screenings washer having a hopper, a grinder coupled to the hopper downstream of the hopper, and a washer coupled to the grinder downstream of the grinder; wherein the washer includes an auger rotor that rotates about an auger rotor axis, a spray wash system, a perforated trough disposed at a bottom of said auger rotor, and a tubular casing directly coupled to a discharge end of said auger rotor, the tubular casing having a severe bend proximate to the discharge end of said auger rotor; the method including the steps of:

(1) feeding the screenings into hopper for conveyance to the grinder;

(2) grinding the screenings in the grinder to produce ground screenings;

(3) feeding the ground screenings directly to the auger rotor;

(4) washing the ground screenings in the auger rotor by spraying a wash fluid under pressure directly onto a portion of the auger rotor and the ground screenings and operating the auger rotor in a forward sequence, in which the auger rotor rotates in a direction that transports the ground screenings towards the discharge end of the auger rotor;

(5) transporting the ground screening by the auger rotor directly to the severe bend without first passing the ground screening through a de-watering section; and (6) compacting and de-watering the ground screenings by forcing the ground screenings through the severe bend which provides resistance to (i.e., partially obstructs) transportation of the ground screenings therethrough.

BRIEF DESCRIPTION OF THE DRAWINGS

The above-mentioned and other features and advantages of this invention are described below with reference to the accompanying drawings, wherein.

DETAILED DESCRIPTION

Figure 1:
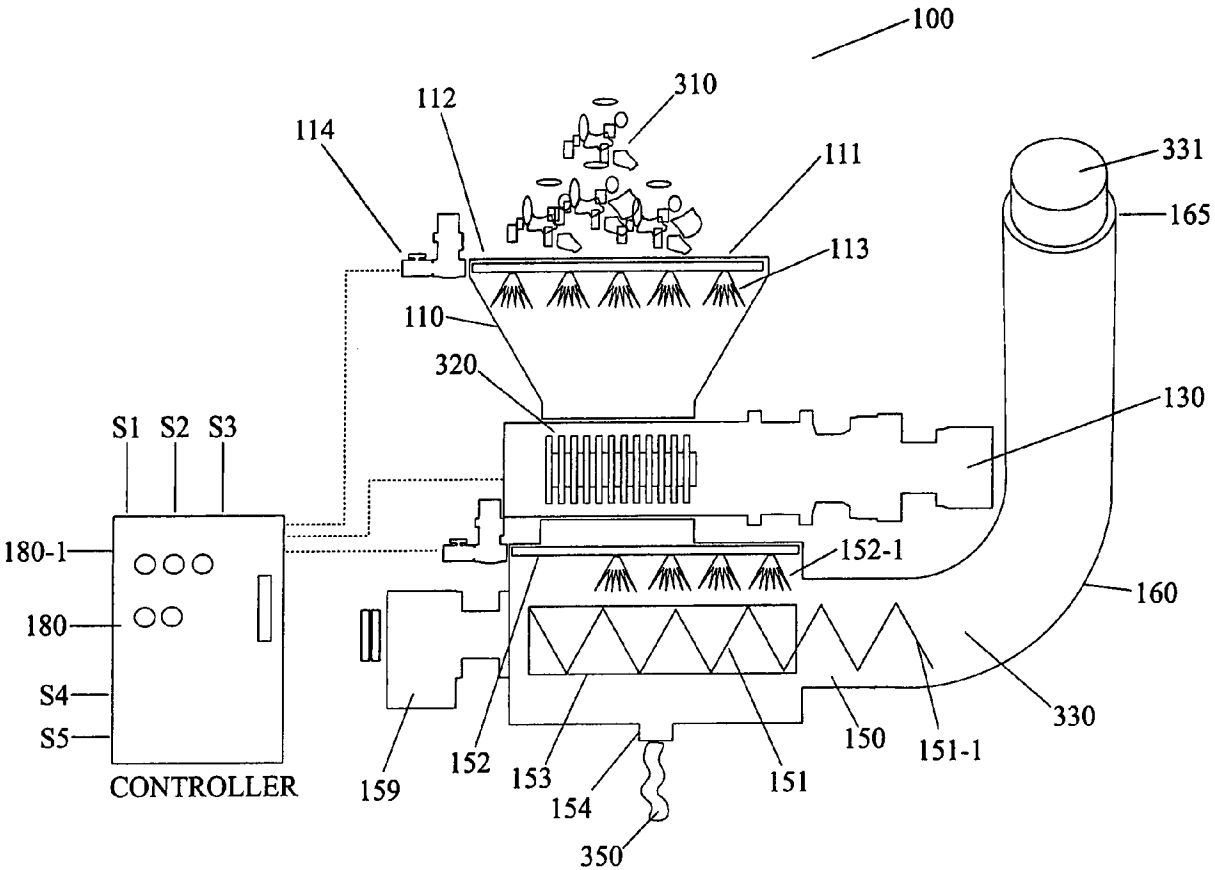
FIG. 1 is a schematic view of a screenings washer in accordance with the invention.

While the invention is open to various modifications and alternative forms, specific embodiments thereof are shown by way of examples in the drawings and are described herein in detail. There is no intent to limit the invention to the particular forms disclosed.

The invention relates to a screenings washer that removes through a wash process soluble substances, such as organic particles, from screenings that are captured by a bar screen or other screenings removal device, and then dries and compacts the screenings prior to their disposal. The term screenings used herein includes, but is not limited to, any influent containing both soluble and non-soluble (i.e., solid) matter. For example, screenings can include sewage waste containing soft organics, such as fecal matter, and solid matter, such as plastics, paper, syringes, and condoms.

As shown in FIG. 1, a self contained screenings washer 100 constructed in accordance with the invention includes a hopper 110 for receiving pre-ground screenings 310 through an inlet 111. The pre-ground screenings 310 are conveyed or directly discharged into the hopper 110. The operation of the screenings washer 100 is preferably synchronized with an existing bar screen or conveyor that delivers the screenings to the hopper 110.

The pre-ground screenings 310 (i.e., prior to being ground) pass through the hopper 110 to a grinder 130, preferably disposed directly beneath the hopper 110. The pre-ground screenings 310 are then ground by the grinder for solids reduction prior to being fed as ground screenings 320 to a washer 150.

The ground screenings 320 are fed to the washer 150 to remove soluble matter 350, such as softer organics (e.g., fecal matter), from the remaining solid matter 360. The washer 150 includes an auger assembly 151 and a tank spray wash system 152 the sprays a wash fluid 152-1. Together, the spray wash system 152 and the auger assembly 151 wash and convey the ground screenings towards an outlet 165 of the screenings washer 100 that is located at an end of a tubular casing or discharge piping 160 coupled to the washer 150. The soluble matter 350 and wash fluid from the tank spray wash system 152 pass through a perforated trough 153 located beneath the auger, collected in a drain 154, and sent to a waste stream (not shown) for further treatment. The washed and captured ground screenings 330 are dewatered and compacted to reduce their volume, and then discharged from the outlet 165 and into a receptacle (not shown) for transportation and disposal.

A control unit 180 is provided to control the operation of the screening washer 100, and in particular, the operation of the grinder and washer to ensure the pre-ground screenings 310 are processed and conveyed through the screenings washer 100 in an efficient manner and without the risk of damage to the screenings washer 100.

Referring to FIGS. 2-12, additional details of the screenings washer 100 will be described according to preferred embodiments of the invention.

The hopper 110 is preferably formed in the shape of a funnel, having a large opening that forms the inlet 111 for the screenings washer 100. The pre-ground screenings are gravity fed downwardly through the hopper, and may be aided by a hopper spray wash system 112 disposed at or near the inlet 111. Solenoid valve 114 may be provided to control discharge of the hopper spray wash fluid 113 from the hopper spray wash system 112. Additionally, a manually operated valve may be included to shut off or regulate the flow of spray wash fluid 113 that is provided to the hopper spray wash system 112. A gasket mounting flange 115 is disposed between the hopper 110 and the grinder 130 to ensure a watertight fit. The hopper material should be made from a non-corrosive material, such as AISI Grade 304 Stainless Steel.

The grinder 130 includes end housings, covers, shafts, side rails, a reducer, a motor, cutters, spacers, bearings, and seals. The grinder 130 should be adapted for continuous operation for processing wet or dry screenings. Preferably, the grinder is a two-shafted design and is oriented horizontally above the washer 150 to save space and make use of gravity to feed or drop the ground screenings 320 into the washer. The two-shafted design for the grinder 130 includes two parallel shafts alternately stacked with individual intermeshing cutters 131 and spacers positioned on the shaft to form a helical pattern. The two shafts should counter-rotate with the driven shaft preferably operating at a lower speed than the drive shaft, such as two-thirds the speed of the drive shaft.

In one preferred embodiment, the housing for the grinder 130 can be made from iron, such as American Society for Testing and Materials ("ASTM") A 48-83 Class 40 grey iron, and include cast in place deflectors to protect the grinder bushings and to guide the screenings directly into a cutting chamber, the cutting chamber having a nominal height of 18 inches and an opening of 14⅝ inches in width. The grinder can have top covers made from iron, such as ASTM A 536-84 ductile iron, and bottom covers made from rolled plates, such as ASTM A 36 hot rolled plates. The grinder drive and driven shafts can be made from steel, such as American Iron and Steel Institute ("AISI") 4140 heat treated hexagon steel with a tensile strength rating greater than 149,000 psi; and the shaft diameters should be at least 2½ inches.

The side rails for the grinder 130 are preferably concave to follow the radial arc of the cutters, and are affixed to the grinder so as to maintain a clearance not greater than ⅜ inch between the major diameter of the cutter and the concave arc of the side rails. Maintaining this clearance directs larger particles towards the cutters to ensure fineness of the grind. The side rails preferably have evenly spaced slots, which increase flow and decrease head loss. The side rails can be made from iron, such as ASTM A 536-84 ductile iron.

The speed reducer for the grinder 130 is preferably a grease filled cycloidal type with a "heavy shock" load classification, and with a reduction ratio of 43:1. The high-speed shaft of the grinder should be directly coupled with the reducer using a two- or three-piece coupling.

The motor for the grinder 130 according to one selection is preferably rated at 10 HP and 1725 rpm. The running torque per horsepower should be around 1550 in-lbs minimum at continuous loading and 4550 in-lbs at momentary load peaks.

The inside configuration of both cutters 131 for the grinder 130, as well as the spacers, are preferably hexagonal and made to fit their respective shafts with a total clearance below 0.040 inch across the flats to assure positive drive, minimize wear on the cutters, and increase the compressive strength of the spacers. The cutters 131 and spacers should be made from AISI Heat Treated Alloy Steel, surface ground for uniformity, and through-hardened to a minimum 45-50 Rockwell C.

The cutters 131 should be designed with 11 cam shaped teeth per cutter, and the height of each tooth should not exceed ¾ inch above the root diameter. The cutter to cutter root diameter overlap should not be less than 1/16 inch, and preferably greater than ⅜ inch, to maintain the optimum cutting efficiency while incurring the least amount of frictional losses. The minimum cutter diameter should be 7 1/25 inches. The cutter 131 should exert a continuous force of 415 lbs/HP or more and 1200 lbs/HP at momentary load peaks at the tooth tip.

The cutter shafts' radial and axial loads should be borne by a sealed oversize deep-groove (CONRAD type) ball bearing at each end, and the cutter shaft bearings should be protected by a combination of a tortuous path device and end face mechanical seals. Face materials should be tungsten carbide, and should not require an external flush or any periodic lubrication.

Examples of preferred grinders for use the screening washer 100 are the 5 HP MUFFIN MONSTER Model 30000 and the 10 HP MACHO MONSTER 40000 manufactured by JWC ENVIRONMENTAL.

The use of a grinder, and preferably the two-shafted grinder 130 to grind the pre-ground screenings 310 prior to washing these screenings in the washer 150 provides certain distinct advantages. By grinding the pre-ground screenings 310, including the soluble matter 350 and solid matter 360, the captured ground solid matter is reduced in size and broken down to expose more surface area to the washing process, making the ground solid matter significantly easier to wash, while allowing the ground soluble matter to easily pass through the washer's perforated trough 153 and returned to the waste stream. The remaining ground and washed solid matter 360 can then be transported by auger assembly 151 for efficient compaction and de-watering merely by forcing the washed solid matter through a severe bend as discussed below. Therefore, the grinder improves the washing of the pre-round screenings 310 so that substantially all the soluble matter 350 (e.g., fecal matter) is removed to produce an odorless discharge with less water content and that can be efficiently compacted into plugs or cakes 331 for convenient storage and disposal. Furthermore, in the case where the screenings include hazardous material such as syringes, condoms, and other hazardous material, grinding these materials into small pieces can reduce or eliminate their potential danger to personnel that come into contact with the plugs 331 after they are discharged from the screenings washer 100.

Figure 2:
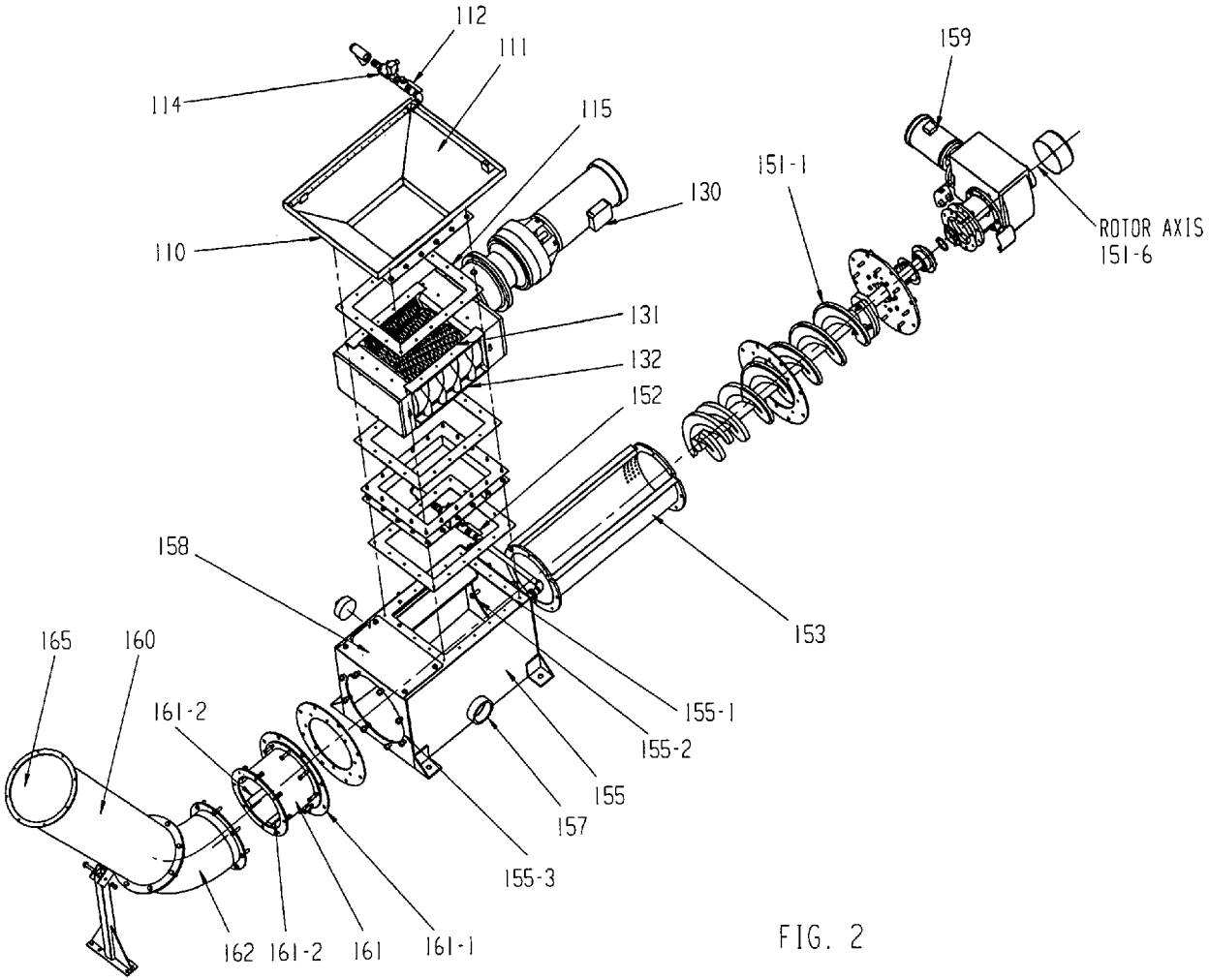
FIG. 2 is an exploded view of the screenings washer in accordance with the invention.

The washer 150 includes a tank 155, which is disposed downstream of the grinder 130 and preferably coupled directly below an outlet 132 of the grinder 130 via interconnects or gasket mounting flanges 134. This configuration allows the ground, pre-washed screenings 320 to be gravity fed (i.e., dropped) into an inlet 155-1 formed at the top of the washer 150. The tank 155 further includes two openings 155-2 and 155-3 on opposite sides of the tank for positioning the auger assembly 151. As shown in FIG. 2, the opening 155-3 also serves as an outlet from the tank 155 for discharging the washed ground screenings 330 just prior to compaction.

The tank 155 is preferably made from a corrosion resistant material, such as 10 gauge AISI Grade 304 Stainless Steel an includes supports for mounting the tank spray wash system 152. The tank 155 further includes the drain 154 that collects and sends to the waste stream for further treatment the soluble matter 350 and wash fluid from the tank spray wash system 152 that pass through the perforated trough 153. In addition to the drain 154, the tank 155 should include a flush port 157, as well as an inspection cover 158 for access to the inside of the tank.

The perforated trough 153 is disposed within the tank 155 and preferably has ¼ inch perforations that separate the soft organics and liquid from the washed ground screenings 330. The perforated trough should be configured so as to be replaceable and made from a corrosion resistant material, such as AISI Grade 304 Stainless Steel.

The auger assembly 151 includes an auger rotor 151-1 rotatably disposed within the tank 155 and mechanically coupled at one end to an auger motor 159 with appropriate bearings, gaskets, packings or mechanical seal, etc. The auger rotor 151-1 rotates about a rotor axis 151-6 that is substantially horizontal or inclined only slightly to enhance de-watering of the washed ground screenings 330. Orienting the auger rotor 151-1 and, therefore, the auger assembly 151 horizontally improves the wash process and saves space. The auger rotor 151-1 should be made from high wear-resistant, alloy steel.

Figure 7:
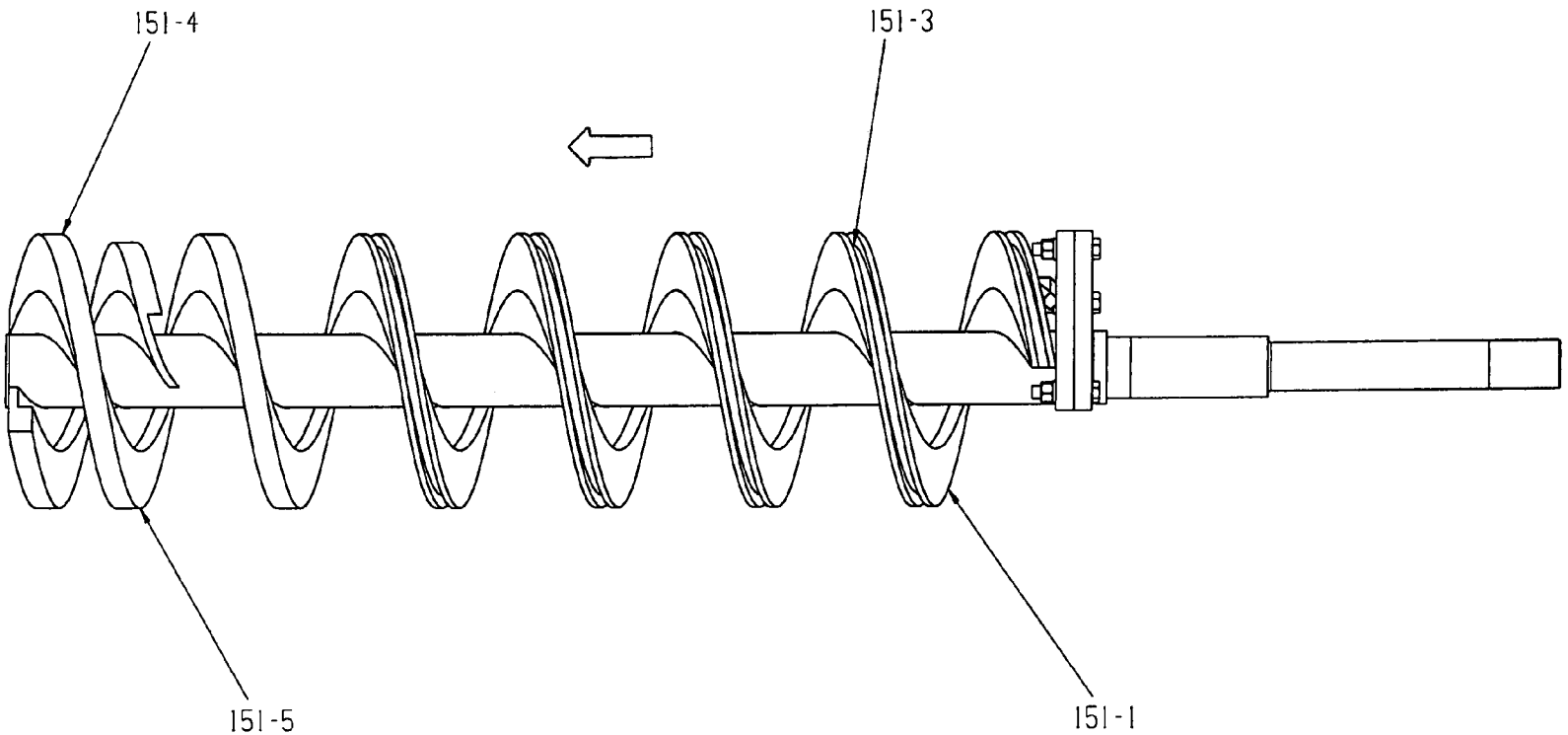
FIG. 7 is a side view of an auger rotor for the screenings washer in accordance with the invention.

As shown in FIG. 7, the auger rotor 151-1 is in the form of a spiral or helix and includes a replaceable brush/wiper 151-3 on the outer edge of the spiral that contacts the inside of the perforated trough 153 to clean and protect the perforated trough from excessive wear. Accordingly, the replaceable brush/wiper 151-3 should extend the length of the perforated trough 153.

Figure 6:
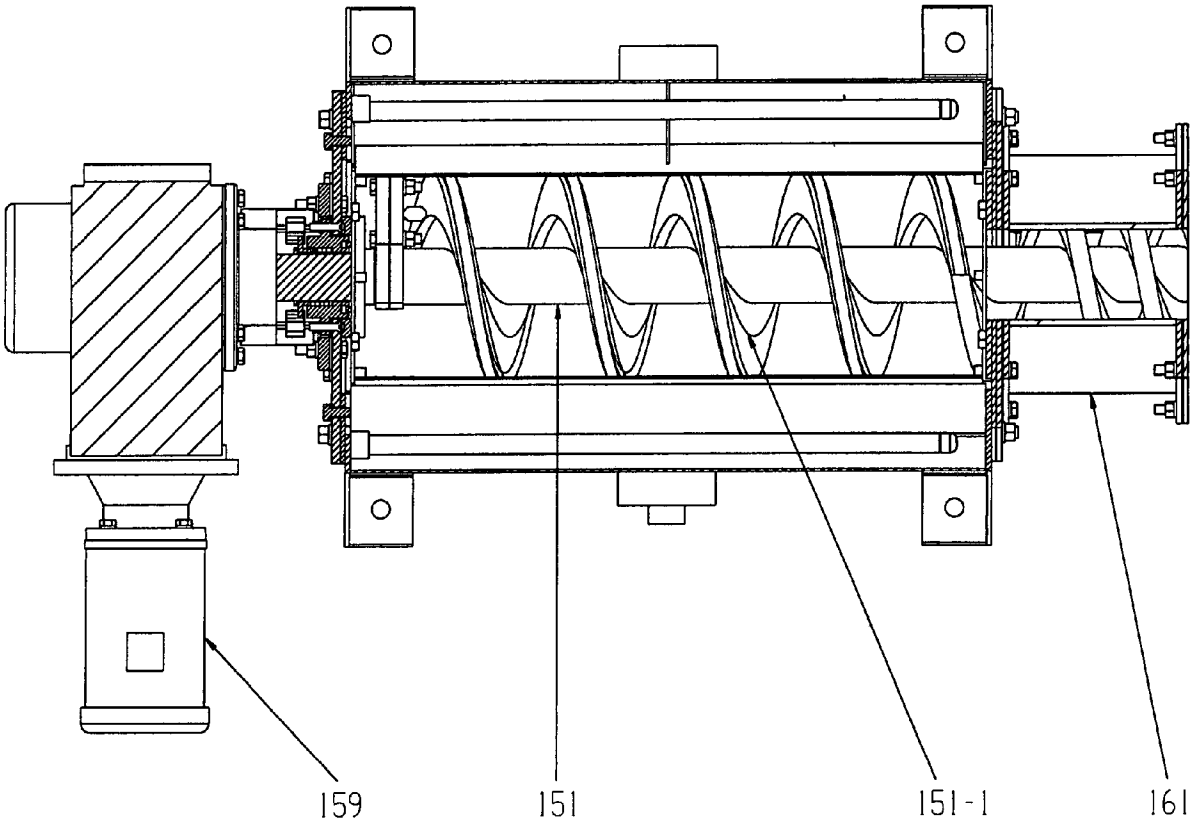
FIG. 6 is a section view of the screenings washer in accordance with the invention taken along the section VI-VI in FIG. 3.

On the other hand, as shown in FIGS. 1 and 6, the auger rotor 151-1 can extend beyond perforated trough 153, as well as the outlet 155-3 of the tank 155, and into a portion of the tubular casing or discharge piping 160. Furthermore, in a preferred embodiment, the auger rotor 151-1 is formed into a dual spiral or helix 151-4 at a discharge end of the auger rotor. The dual spiral 151-4 can be obtained by a first spiral that substantially extends the entire length of the auger rotor, and adding a second spiral 151-5 at the discharge end of the auger rotor 151-1 that extends a short distance in the upstream direction of the auger rotor.

The dual spiral 151-4 prevents uneven loading of the auger rotor 151-1 due to uneven contact with the formed plug 331. That is, as a result of the dual spiral 151-4, the resultant force on the auger rotor is more evenly distributed around the rotor axis 151-6. Additionally, the dual spiral 151-4 aids in the de-watering of the washed ground screenings 330 by decreasing the pitch between flights causing pre-compaction of the washed screenings prior to their being conveyed to an elbow or bend transport segment 162 of the discharge piping 160 for compaction as discussed in more detail below.

The auger rotor 151-1 is driven by an auger motor 159 coupled near the upstream end of the auger rotor. When sizing the auger motor 159, it is preferable to ensure that the speed of the auger rotor 151-1 does not exceed 33 ft./min. at the spiral tip. Additionally, the transport speed of the auger rotor 151-1 should remain below 6.25 ft./min. In a preferred design, the auger motor 159 is an electric motor that is coupled to a speed reducer and rated at a minimum of 3 HP and 1725 rpm. In this preferred design, the speed reducer should have a reduction ratio of 155:1, and preferably be a grease filled right angle drive coupled to the electrical motor by a BOLEX coupling.

The tank spray wash system 152 is mounted to the tank 155 and provides wash fluid 152-1, preferably under pressure, to the auger assembly 151 and the perforated trough 153. In particular, the tank spray wash system 152 is provided to rinse the soluble matter 350 from the ground screenings and into the waste stream. Accordingly, to be most effective, the tank spray wash system 152 should be mounted over the auger assembly 151 and the perforated trough 153.

The tank spray wash system 152 can be controlled through a solenoid valve 152-2 that is automatically energized by the control unit 180 to spray wash fluid 152-1 when the auger rotor 151-1 is rotating. The solenoid valve 152-2 can then be automatically de-energized when the auger rotor 151-1 stops rotating. In addition, a manual hand operated valve should be provided to control the wash fluid flow to the tank spray wash system 152. This valve can be used to turn the wash fluid 152-1 on or off and to adjust its rate of flow to the tank spray wash system 152.

The tubular casing or discharge piping 160 can have three segments, including a straight transport segment 161, the elbow transport segment 162, and a discharged segment 163. All three segments should be made from corrosion resistant material, such as 10 gauge AISI 304 Stainless Steel.

The straight transport segment 161 is coupled via an endplate 161-1 to the outlet 155-3 of the tank 155. The elbow transport segment 162 is coupled to the straight transport segment 161 at a downstream end of the straight transport segment. Finally, the discharge segment 163 is coupled to the elbow transport segment 162 at a downstream end of the elbow transport segment.

As noted above, the auger rotor 151-1 may extend partially into the discharge piping 160. However, the auger rotor 151-1 should not extend beyond the straight transport segment 161. That is, the auger rotor 151-1 should terminate tangent to the bend in the elbow transport segment 162, since the bend serves as a compaction zone 162-1 for the washed ground screenings 330. As shown in FIG. 2, the transport segment 161 includes wear bars 161-2 that serve as a bearing support for the discharge end of the rotor. Additionally, these wear bars provide channel openings for drainage back to the perforated trough. The forced transport of the washed ground screenings 330 by the auger rotor 151-1 through the elbow transport segment press the washed screenings to de-water and compact them in the compaction zone 162-1. In particular, the combination of a forward force on the washed ground screenings 330 from the auger rotor 151-1 transporting the washed screenings through the straight transport segment 162 and an opposing force on the washed screenings from the resistance or partial obstruction caused by the inner wall of the elbow transport segment 162 results in the compaction and de-watering of the washed screenings to form the plug 331 at the downstream end of the elbow transport segment. In one preferred embodiment, the straight transport segment 161 has a length of about 98.4 inches.

In order to ensure sufficient compaction and de-watering, the elbow transport segment 162 should have a severe bend, preferably in the range of about 30 degrees to 90 degrees, and more preferably in the range of about 45 degrees to 90 degrees. The placement of such a severe bend proximate to the discharge end of the auger rotor 151-1 ensures the sufficient compaction and de-watering of the well ground and washed screenings immediately following the washing step. Therefore, the use of a severe bend proximate to the discharge end of the auger rotor 151-1 used to wash and transport screenings that have been well ground and washed eliminates the requirement for a separate de-watering section, such as one that includes an additional de-watering auger and/or drain.

To enhance drainage from the elbow transport segment 162 and the straight transport segment 161, the straight segment may be slightly inclined downwards towards the tank 155, so that the strained liquid from the de-watering process easily flows back the channels created by the wear bars to the perforated trough 153 at the base of the auger 151-1.

Figure 3:
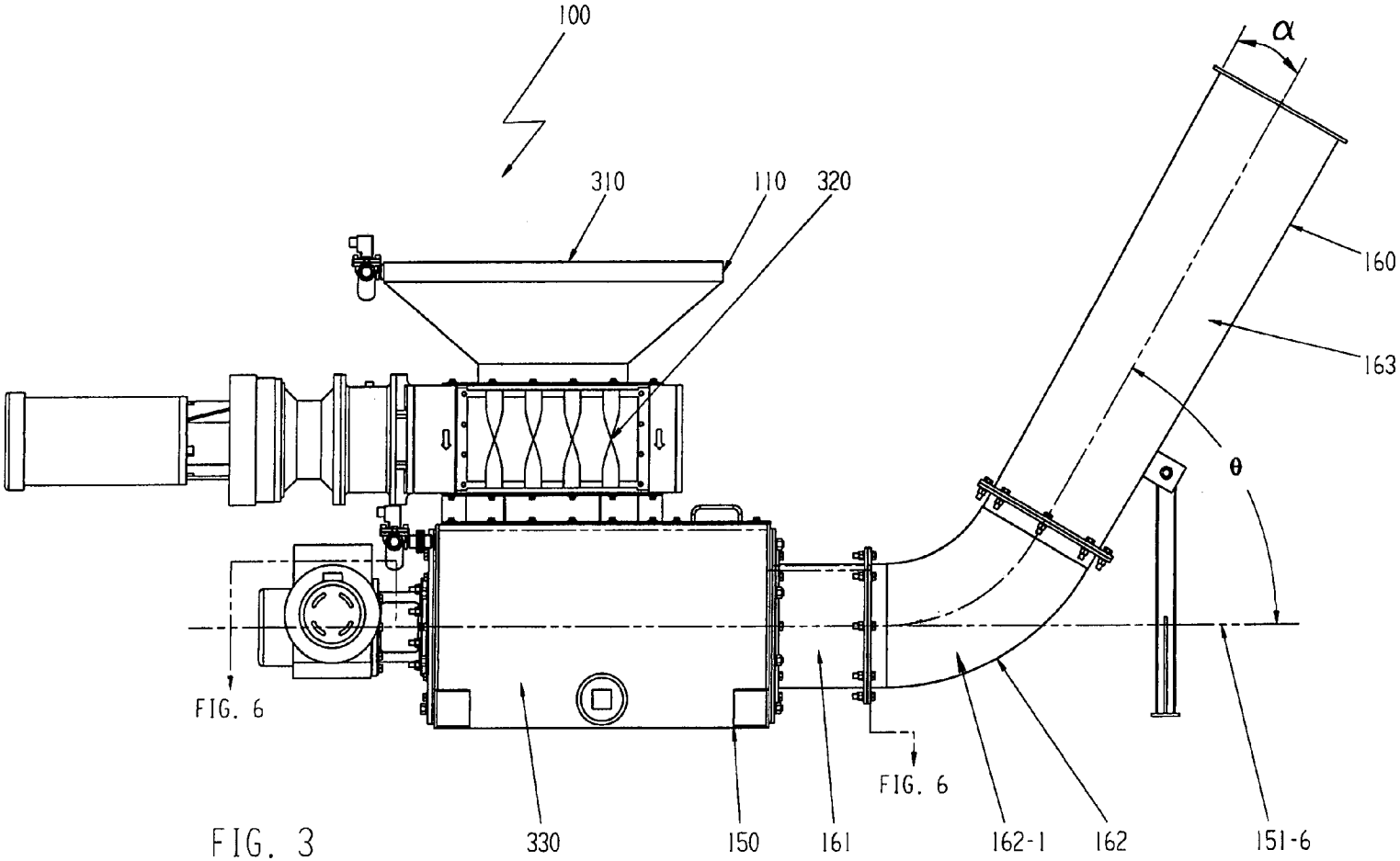
FIGS. 3-5 are side, front and top views, respectively, of the screenings washer in accordance with the invention.
Figure 4:
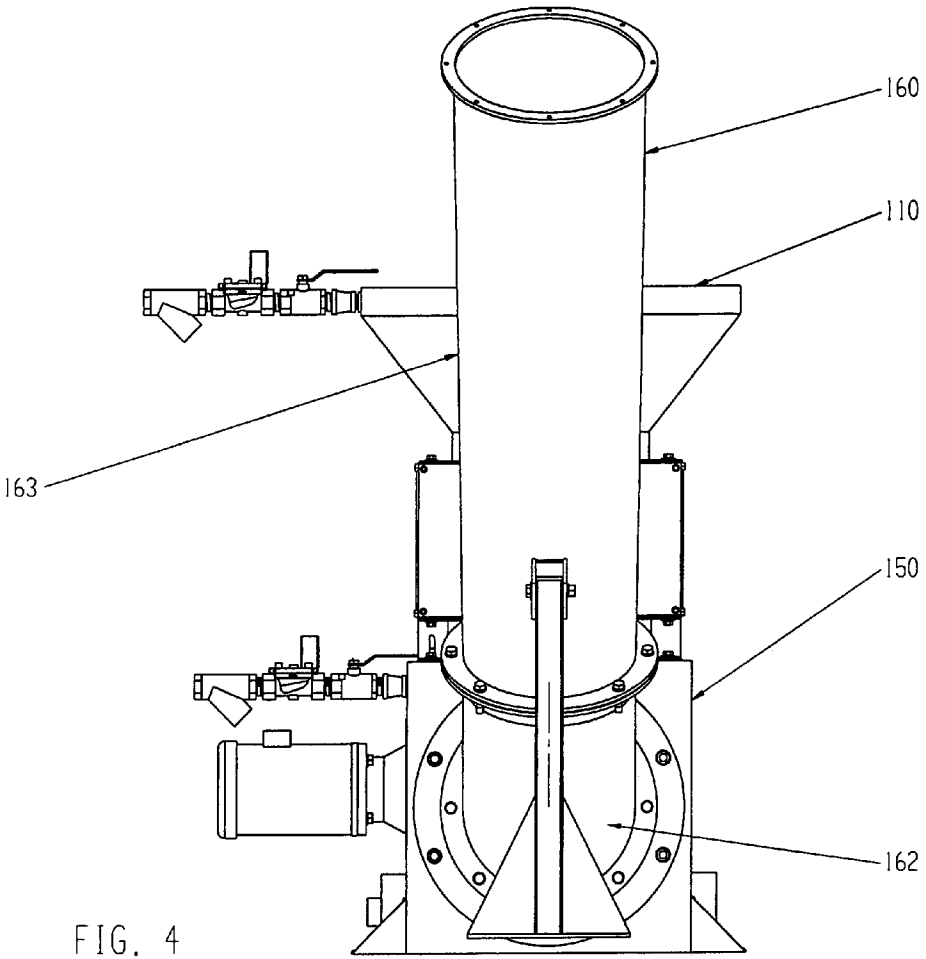
Figure 5:
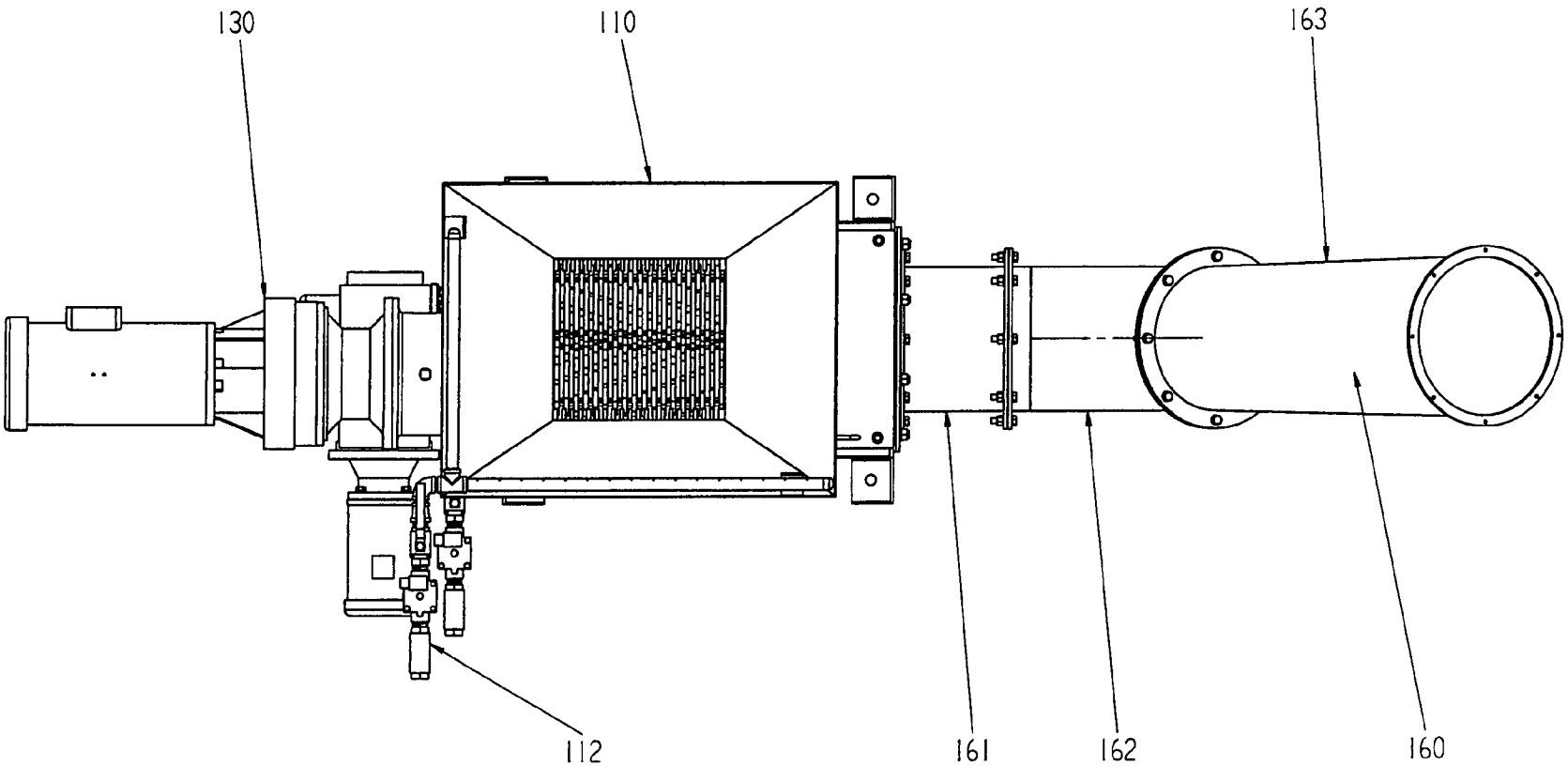
Figure 8:
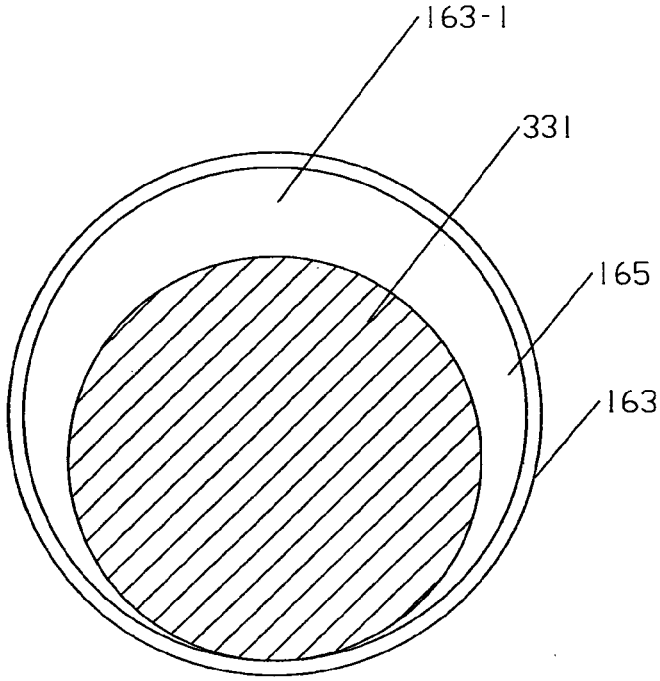
FIG. 8 is an axial view of the discharge end of a discharge segment for the screenings washer in accordance with the invention.

As shown in FIGS. 3 and 8, the discharge segment 163 preferably has a tapered cross-section downstream of the severe bend that expands in a direction of discharge to the outlet 165. Since the plug 331 is essentially completely formed at the discharge end of the elbow transport segment 162, no additional compaction of the plug is required. Therefore, having a tapered discharged segment 163 is important for decreasing additional frictional forces from the inner wall of the discharge segment. Specifically, by tapering the discharge segment 163, the plug 331 can be easily transported upwards for a longer distance with minimum opposing frictional forces, since an air gap or clearance 163-1 forms between the majority of the plug's outer surface and the inner wall of the discharge segment 163. Moreover, the air gap 163-1 aids in allowing air flow around the plug 331, thereby improving the drying of the plug. The taper $\alpha$ of the discharge segment should be a minimum of about 2 degrees to provide good clearance around the plug 331.

Figure 9:
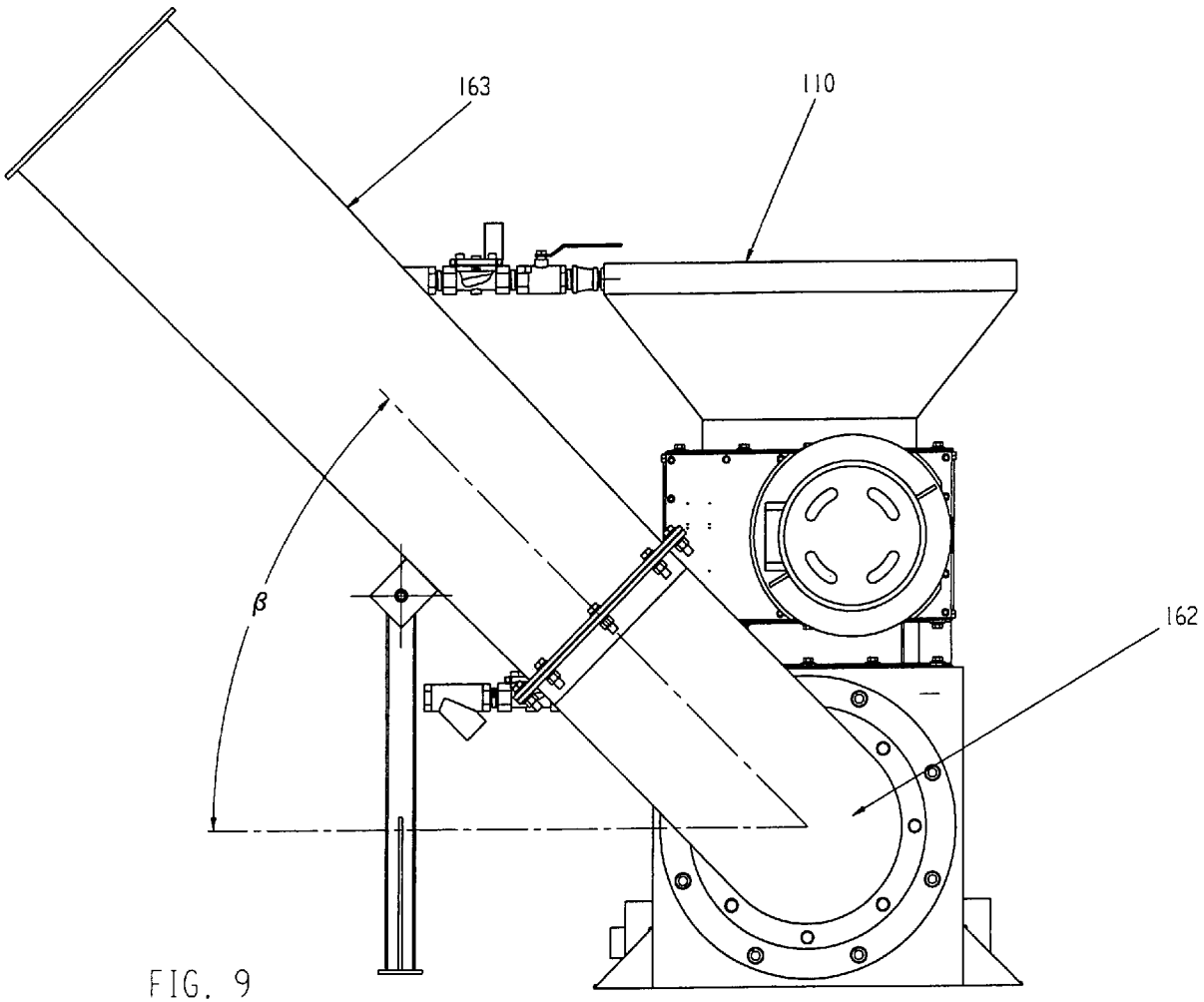
FIG. 9 is a front view of the screenings washer having a discharge segment inclined sideways in accordance with the invention.

As shown in FIG. 3, the discharge segment 163 is inclined upwards by an angle $\theta$ due to the orientation of the elbow transport segment 162. This upwards inclination permits the plugs 331 to be finally discharged from the outlet 165 at a sufficient height to drop into a collecting bin (not shown). When a 90 degree elbow transport segment 162 is used, this segment and the discharge segment 163 also may be inclined sideways by an angle $\beta$ as shown in FIG. 9 to limit the overall height of the screenings washer 100.

The control unit 180 controls the operation of the grinder 130 and the washer 150. In particular, the control unit 180 controls a normal mode operation sequence for both the grinder 130 and the washer 150 and a safe mode operation sequence for these components.

In the normal mode operation, the control unit 180 can operate the grinder 130 and washer 150 to include a reverse sequence operation that causes the ground screenings 320 to be washed multiple times before being transported to the compaction zone 162-1. Specifically, during this normal mode operation, the control unit 180 controls the grinder to operate continuously or sequentially only after the control unit senses a signal S1 from the bar screen or conveyor indicating the presence of screenings to be ground. On the other hand, the control unit 180 controls the washer 150, and in particular the auger rotor 151-1, to operate only after the control unit senses the signal S1. Preferably, the control unit 180 delays the operation of the auger rotor 151-1 for a period of time (e.g., 30 seconds) prior to initiating its operation. This allows time for the bar screen or conveyor to convey the pre-ground and pre-washed screenings 310 to the screenings washer 100.

Figure 10:
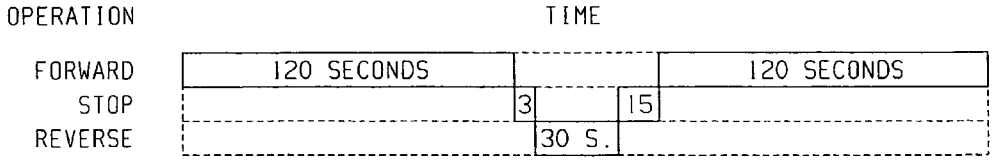
FIG. 10 is a time-line illustrating the operational sequences for controlling the screenings washer according to invention.
Figure 11:
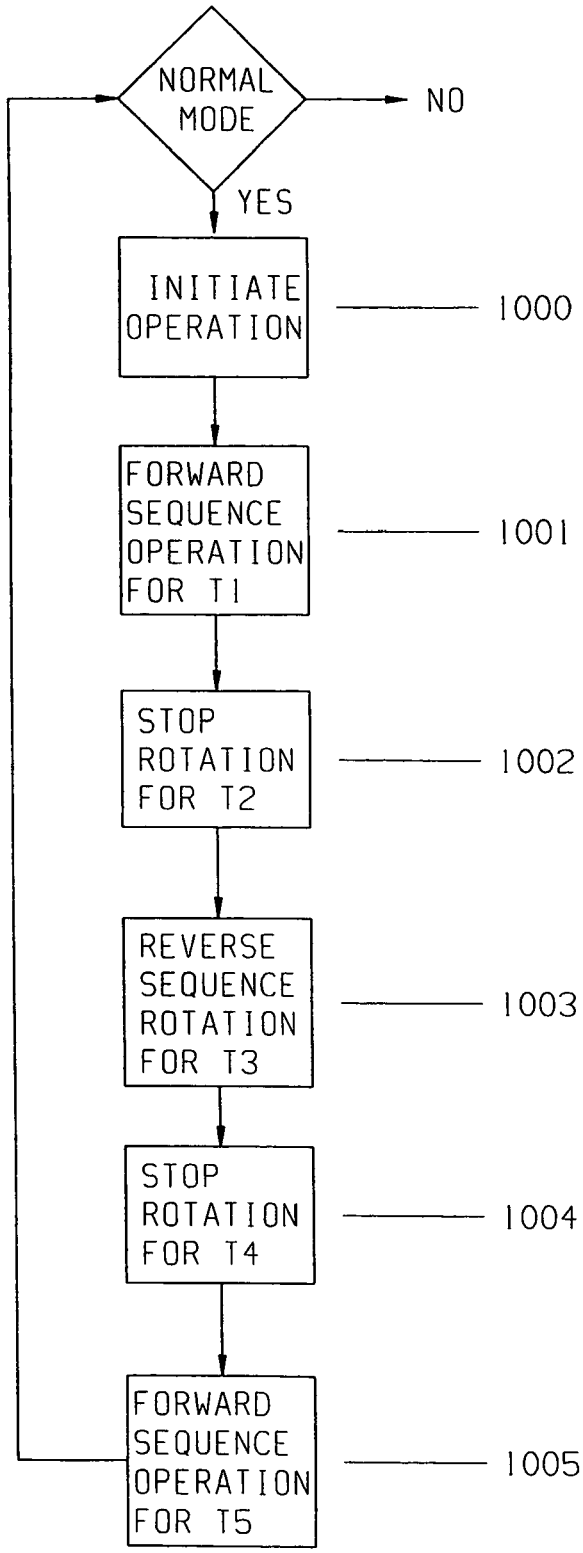
FIGS. 11 and 12 are block diagrams showing various control features in accordance with the invention.

As shown in FIGS. 10 and 11, after the washer operation is initiated (STEP 1000), the control unit 180 controls the washer 150 to run in accordance with a series of operational sequences that include at least one reverse sequence to allow the ground screenings 320 to be washed multiple times. In particular, the control unit 180 controls the washer 150 to operate in a forward sequence (STEP 1001) for a first predetermined period of time T1 (e.g., 120 seconds), wherein the forward sequence causes the auger rotor 151-1 to rotate in a direction that transports the screenings in a discharge direction.

Next, the control unit stops rotation of the auger rotor 151-1 (STEP 1002) for a second predetermined period of time T2 (e.g., 3 seconds) before initiating a reverse sequence of the auger rotor (STEP 1003) for a third predetermined period of time T3 (e.g., 30 seconds), wherein the reverse sequence causes the auger rotor to rotate in a direction opposite to that of the forward sequence and bring the screenings back to the wash zone for a second cleaning. The control unit 180 stops rotation of the auger rotor 151-1 before initiating the reverse sequence in order to prevent any energy buildup in the auger rotor from causing vibration when reversing.

Finally, the control unit again stops rotation of the auger rotor 151-1 (1004) for a fourth predetermined period of time T4 (e.g., 15 seconds) to ensure a thorough cleaning of the screenings before reinitiating a second forward sequence of the auger rotor (STEP 1005) for a fifth predetermined period of time T5 (e.g., 120 seconds).

If, after the second forward sequence of the auger rotor 151-1, the control unit 180 does not sense the signal S1, the auger stops indefinitely. However, if the control unit continues to sense the signal S1, the control unit will continue to cycle the washer 150 through the sequences described above.

During the foregoing normal mode operation, the control unit 180 can also control the grinder 130 to start and stop as required. For example, the grinder 130 can be made to stop when the auger rotor is stopped or operated to run in the reverse sequence.

The safe mode operation can be initiated when, for example, the control unit 180 senses a signal S2 or S3 indicating that the grinder 130 or washer 150 has jammed, respectively. In the case when the grinder 130 jams due to an obstruction, the control unit 180 can stop the grinder and initiate a reverse sequence to reverse the grinder rotation in an attempt to clear the obstruction. Once the obstruction is cleared, the control unit 180 can return the grinder 130 to normal mode operation. If the control unit 180 continues to sense the signal S2, the control unit can repeat the reverse sequence a pre-determined number of times within a set period of time before permanently stopping the grinder 130 and sending a grinder failure indication.

Similarly, in the case when the washer 150, and in particular the auger rotor 151-1, jams due an obstruction, the control unit 180 can stop the auger rotor 151-1 and initiate a reverse sequence to reverse its rotation in an attempt to clear the obstruction. Once the obstruction is cleared, the control unit 180 can return the auger rotor 151-1 to normal mode operation. If the control unit 180 continues to sense the signal S3, the control unit can repeat the reverse sequence a predetermined number of times within a set period of time before permanently stopping the auger rotor 151-1 and sending a washer failure indication. The grinder 130 may be controlled to continue operation during a washer failure indication.

Figure 12:
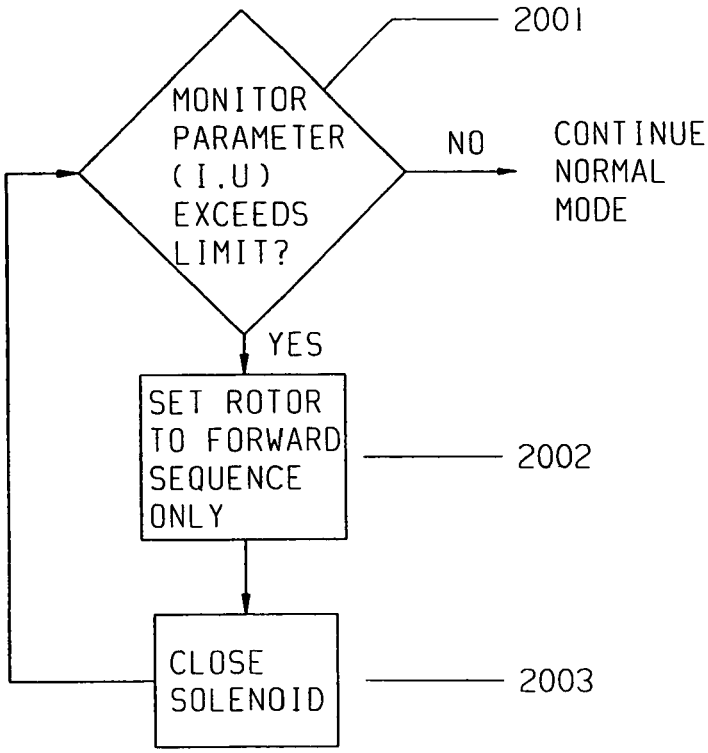

In another preferred embodiment as shown in FIG. 12, added protection for the screenings washer 100 is provided by monitoring current and/or voltage signals S4 and S5 (e.g., using a power transducer 180-1 as part of the control unit 180) to determine the power consumption of the screenings washer 100, or the washer 150 in particular. If the power consumption exceeds a maximum allowable threshold value (STEP 2001), the control unit 180 changes the run sequence of the auger rotor 151-1 to a forward only rotation (STEP 2002) and closes the solenoid valve of the tank spray wash system 152 (STEP 2003). This added safety feature tailors the run sequences of the washer 150 to prevent mechanical failure or auger motor overload due to the screenings washer 100 producing too dry a discharge. If the transported screenings become too dry, the force required to push the screenings plug 331 can exceed the screenings washer's design limit.

To achieve the foregoing features, the control unit 180 should be configured to provide independent control of the grinder 130 and the washer 150. The controller can be equipped with the necessary ON, OFF, RESET, AUTO, and TIMER position selector switches for each of the grinder 130 and the washer 150; and also include an interface panel for an operator to set the various sequence parameters for normal mode and safety mode operations and for displaying failure information, service reminders, etc.

As described above, the screenings washer according to the invention provides a self-contained hopper-fed system used to effectively grind, wash, compact, and de-water screenings that have been captured by a bar screen or other screenings removal device. Tests run on screenings washers in accordance with the invention produce plugs compared to the original screenings that about are 50 percent drier (i.e., de-watered by about 50 percent) and about 75 to 85 percent compacted (i.e., reduced in volume). Furthermore, the plugs are lighter and cleaner (with significantly reduced fecal content) than screenings processed by conventional washers. For example, in one test that was conducted, screenings received from a bar screen containing 84.83 percent water was processed by a screenings washer according to the invention. The discharged plugs from the screenings washer contained 52.8 percent water with a Chemical Oxygen Demand ("COD") measured at 318 mg/L.

The flow capacity of the screenings washer will depend on a number of factors, including the capacity of the grinder, the washer, and the discharge piping. In one preferred design that uses a 10 HP grinder with a 11 tooth cam cutter and a 285 mm auger rotor driven by a 3 HP motor, the flow capacity was designed to be between 90 and 150 $ft^3$/hr. In another preferred design that uses a 5 HP grinder with a 7 tooth cam cutter and a 285 mm auger rotor driven by a 3 HP motor, the flow capacity was designed to be 25 $ft^3$/hr.

The screenings washer of the invention provides several advantages over the conventional screenings washers. For example, an advantage of the screenings washer in accordance with one aspect of this invention that includes a severe bend proximate to the discharge end of the washer auger rotor is the elimination of a separate dewatering and compaction section, thereby making the screening washer compact, efficient, and mechanically and electrically simple.

An advantage of the screenings washer according to another aspect of the invention that includes a tapered discharge transport segment is the reduced resistance against the transport of the plug after being discharged from elbow transport segment, as well as the improved drying of the plug during this final transport stage.

An advantage of the screenings washer according to another aspect of the invention that includes a screenings washer having an auger rotor with a dual spiral is the prevention of uneven loading of the auger rotor. A further benefit is the added de-watering and compaction of the washed ground screenings due to the decreased pitch between flights causing pre-compaction of the washed screenings prior to their being conveyed to the elbow transport segment.

An advantage of the screenings washer according to another aspect of the invention that includes a control unit to control the operational sequence of the washer to include reverse mode is the ability to perform multiple washes of the screenings prior to compaction and de-watering.

An advantage of the screenings washer according to another aspect of the invention that includes a screenings washer having a control unit that monitors the current and/or voltage corresponding to the power consumption of the screenings washer is the tailoring of the run sequences to prevent mechanical failure or auger motor overload.

Therefore, in view of the foregoing, it is readily apparent that the subject screenings washer provides an improved mechanism for grinding, washing, de-watering, and compacting screenings for disposal.

Other aspects, objects and advantages of the invention can be obtained from a study of the drawings, the disclosure and the appended claims.

The invention claimed is:

1. An integrated screenings washer system, comprising in order:

an input hopper that collects screenings;

a dual shafted grinder coupled to said input hopper, said dual shafted grinder having interleaved rotating cutting elements defining a grinding zone downstream of said hopper where said grinder grinds the screenings received from said hopper;

a spray washer operably coupled to said grinder downstream of said grinder, said washer comprising a nozzle to deliver a spray of washer fluid generally downward with the output of said dual shafted grinder;

an auger rotor having an auger rotor axis that is aligned substantially in parallel with the axes of rotation of said dual shafted grinder and positioned beneath said grinding zone; said auger receiving the screenings ground by said dual grinder and said washer fluid and transports the ground screenings to a discharge end of said auger rotor, a discharge disposed under said auger rotor, said discharge draining the wash fluid; and a tubular casing coupled to the discharge end of said auger rotor, said tubular casing having a bend proximate to the discharge end of said auger rotor, said bend partially obstructing transportation of the ground screenings transported by said auger rotor so as form a compaction zone that compacts and de-waters the ground screenings from a substantial portion of the wash fluid remaining in the ground screening after passing the discharge end of said auger rotor.

2. The screenings washer according to claim 1, wherein said dual shafted grinder has counter-rotating shafts to feed the ground screenings onto said auger rotor.

3. The screenings washer according to claim 2, wherein said dual shafted grinder is disposed directly above said auger rotor and drops the ground screenings directly into the path of said spray washer prior to striking said auger rotor.

4. The screenings washer according to claim 1, wherein said spray wash system sprays the wash fluid onto the portion of said auger rotor having ground screenings in contact with said auger.

5. The screenings washer according to claim 1, wherein said spray wash system sprays the wash fluid onto a portion of said auger rotor at a position downstream of where the ground screenings first contact with said auger.

6. The screenings washer according to claim 1, wherein said tubular casing includes an elbow transport segment that defines said bend, and a discharge segment coupled directly to said elbow transport segment downstream of said elbow transport segment, said discharge segment having a tapered cross-section expanding in a direction of discharge of the ground screenings.

7. The screenings washer according to claim 6, wherein said tapered cross-section expands beginning from where said discharge segment is coupled directly to said elbow transport segment.

8. The screenings washer according to claim 6, wherein the tapered cross-section expands at an angle of at least 2 degrees.

9. The screenings washer according to claim 1, wherein the bend is between about 30 degrees and 90 degrees.

10. The screenings washer according to claim 1, wherein said auger rotor is positioned beneath said grinding zone and said auger rotor axis is substantially centered between the axes of rotation of each of said shafts of said dual shafted grinder.

11. The screenings washer according to claim 1 wherein said spray wash system further comprising a series of nozzles.

12. A screenings washer system comprising:

a tapered hopper that collects screenings;

a dual shafted grinder coupled to said hopper downstream of said hopper, each shaft having a series of cutting disks separated by spacers, said grinder having a series of interleaving cutting teeth from each shaft forming a grinding zone through which said screenings pass and are ground to a reduced size;

a washer comprising spray nozzles arrayed in a direction substantially the same as the rotational axes of said dual shafts of said grinder; an auger rotor having an axis of rotation substantially aligned with the axes of rotation of said dual shafts of said grinder, said auger rotor receiving the screenings ground by said grinder and transporting the ground screenings to a discharge end of said auger rotor, said washer delivering a wash fluid to said auger rotor and the ground screenings in contact with said auger rotor while said auger rotor conveys the ground screenings along the rotor axis to the discharge end of said auger rotor, a drain for the wash fluid sprayed delivered to said portion of said auger rotor; and a tubular casing directly coupled to the discharge end of said auger rotor, wherein said tubular casing includes an elbow transport segment and a discharge segment.

13. The screenings washer according to claim 12, wherein said dual shafted grinder has counter-rotating shafts to feed the ground screenings onto said auger rotor.

14. The screenings washer according to claim 13, wherein said dual shafted grinder is disposed directly above said auger rotor and drops the ground screenings directly into the path of said spray washer prior to striking said auger rotor.

15. The screenings washer according to claim 12, wherein said wash system delivers the wash fluid to a portion of said auger rotor having ground screenings in contact with said auger.

16. The screenings washer according to claim 12, wherein said wash system delivers the wash fluid to a portion of said auger rotor at a position where the ground screenings first contact with said auger.

17. The screenings washer according to claim 12, wherein said elbow transport segment that defines a severe bend, and said discharge segment is coupled directly to said elbow transport segment downstream of said elbow transport segment, said discharge segment having a tapered cross-section expanding in a direction of discharge of the ground screenings.

18. The screenings washer according to claim 17, wherein said tapered cross-section expands beginning from where said discharge segment is coupled directly to said elbow transport segment.

19. The screenings washer according to claim 17, wherein said tapered cross-section expands at an angle of at least 2 degrees.

20. The screenings washer according to claim 12, wherein said bend is between about 30 degrees and 90 degrees.

21. The screenings washer according to claim 12, wherein said bend is between about 45 degrees and 90 degrees.

* * * * *